United States Patent [19]

Dompas et al.

[11] 3,990,498

[45] Nov. 9, 1976

[54] METHOD OF CONTINUOUS CASTING

[75] Inventors: Marc Dompas, Wilrijk; John Dompas, Olen, both of Belgium

[73] Assignee: Metallurgie Hoboken-Overpelt, Brussels, Belgium

[22] Filed: Mar. 28, 1975

[21] Appl. No.: 563,235

[30] Foreign Application Priority Data

Dec. 16, 1974 Luxemburg ..... 71497

[52] U.S. Cl. ..... 164/82; 164/138; 164/273 R; 249/135

[51] Int. Cl.[2] ..... B22D 11/04

[58] Field of Search ..... 249/135; 164/41, 138, 164/273 R, 82, 281; 29/198

[56] References Cited

UNITED STATES PATENTS

| | | | |
|---|---|---|---|
| 2,472,930 | 6/1949 | Wilkes | 29/198 |
| 3,120,702 | 2/1964 | Smith, Jr. | 29/198 X |
| 3,233,312 | 2/1966 | Cowan et al. | 29/198 X |
| 3,302,251 | 2/1967 | Speith et al. | 249/135 |
| 3,339,588 | 9/1967 | Nilles | 164/183 X |
| 3,349,836 | 10/1967 | Rossi | 249/135 X |
| 3,429,365 | 2/1969 | Schrewe | 164/273 R |
| 3,521,849 | 7/1970 | Voss | 249/135 |
| 3,709,722 | 1/1973 | Corrigan et al. | 164/138 X |

FOREIGN PATENTS OR APPLICATIONS

| | | | |
|---|---|---|---|
| 725,540 | 1/1966 | Canada | 249/135 |

*Primary Examiner*—Ronald J. Shore
*Attorney, Agent, or Firm*—Fred Philpitt

[57] ABSTRACT

A mold for the continuous casting of metals, in which at least its inner part is made of a refractory material chosen from the group of materials comprising tantalum, niobium, tantalum-base alloys and niobium-base alloys.

7 Claims, 2 Drawing Figures

METHOD OF CONTINUOUS CASTING

Figure 1:
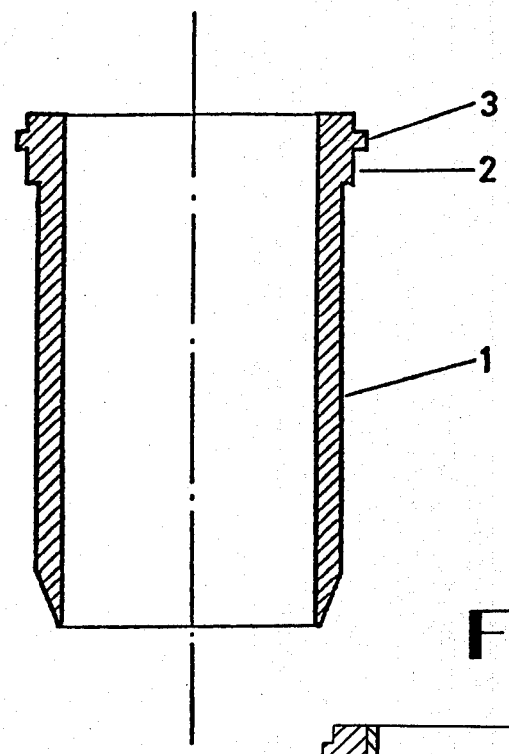

The present invention relates to a mold for the continuous casting of metals, more particularly for the continuous casting of copper and copper-base alloys.

BACKGROUND

In the continuous vertical casting of metals, the molten metal is poured continuously into a mold with open top and bottom in which the metal solidifies superficially to form a continuous pseudo-ingot solid enough to be drawn from the bottom of the mold. Superficial solidification of the molten metal results from the thorough cooling which it undergoes upon contact with the wall of the mold, which is strongly cooled by a flow of water.

Up to now, graphite-lined copper molds were mostly used for the continuous casting of copper or copper-base metals. The lining wears out very quickly and cannot be re-used when the casting operation has to be interrupted for any reason.

In addition, copper molds have been used for the continous casting of large shapes, such as cakes of copper and copper-base alloys. This process has the drawback that the thin solidified metal skin tends to stick to the mold walls, and this still very weak skin is subject to being torn under the pulling strain to which it is subjected from the lower part of the ingot when drawn out of the mold by the extraction mechanism.

Copper molds are also of current use in continuous steel casting. In this case, the ingot may not only be torn as described above with respect to continuous copper casting, but there are also fusible copper particles (from the mold) which are ripped off by the steel and are dissolved and diffused into the steel; such particles make the ingot brittle at red heat, and cracks are produced.

In order to avoid the drawbacks of the abovementioned molds, molybdenum molds or molybdenum-lined molds have already been suggested, particularly for continuous steel casting. However, since molybdenum is brittle at room temperature, such molds are not only hard to machine but are in addition subject to cracking upon contact on the one hand with the ingot submitted to traction and on the other hand with the cooling fluid or the cold outside shell of the mold (in the case of a lining).

THE PRESENT INVENTION

The mold according to the present invention avoids the drawbacks of the known molds.

The present invention relates to a mold for the continuous casting of metals, more particularly of copper and copper-base alloys, characterized in that at least its inner part is made up of a refractory material chosen from the group of materials comprising tantalum, niobium, tantalum-base alloys and niobium-base alloys.

The invention is quite surprising because tantalum had previously been considered unsuitable as structural material for dies used for introducing a copper wire in the lower part of a crucible filled with molten copper, in the continuous copper casting process called "dip forming", notably because of the weldability of copper to tantalum.

The mold according to the present invention may preferably be made entirely of said refractory material.

When use is made of only a lining of the said refractory material, it is advantageous to make the outer shell of the mold of copper and to bond said lining on to the outer part by explosion, or to co-extrude said outer part made of copper with the inner part made of the said refractory material.

The refractory material is preferably tantalum.

The accompanying drawing FIG. 1 shows an axial section of a mold according to the invention, intended for the continuous (or semicontinuous) casting of copper billets. The reference numeral 1 designates a tubular tantalum mold, the head of which has a small shoulder 2, on its outside, itself provided with a collar 3, and the lower edge of which is bevelled on its outside at an angle of 15° to 25°. The said mold has been manufactured by lathe machining of a tantalum ingot obtained by electron-beam fusion.

Figure 2:
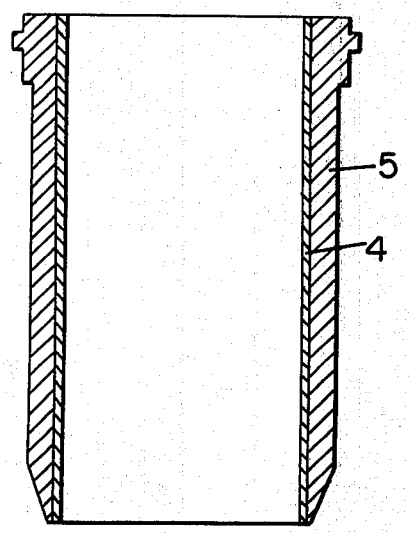

FIG. 2 is an axial section of another embodiment of the present invention in which there is an inner lining of refractory material of the type specified above and an exterior shell of copper.

When provided with a cooling jacket as described in the commonly owned U.S. patent application Ser. No. 523405 filed Nov. 13, 1974, by John Dompas, the said mold has not shown the slightest sign of wear after three weeks of service, whereas under the same conditions of casting a grahite lining of a conventional mold accounts for an average life span of about one week.

We claim:

1. In the known method of casting metals wherein molten metal is poured into a mold with an open top and bottom in which the metal solidifies superficially to form a pseudo ingot solid enough to be drawn from the bottom of the mold, the improvement which comprises utilizing as said mold a mold wherein at least the inner part is made of a refractory material chosen from the group consisting of tantalum, niobium, tantalum base alloys, and niobium base alloys.

2. A method according to claim 1 wherein said metal to be cast is copper or a copper-base alloy.

3. A method according to claim 1 wherein said mold is composed entirely of said refractory material.

4. A method according to claim 1 wherein said inner part of refractory material is tantalum.

5. A method according to claim 1 wherein said mold has a shell portion surrounding said inner part of refractory material, said shell portion being composed of copper.

6. A method according to claim 5 wherein said inner part is bonded to said outer shell portion by explosive bonding.

7. A method according to claim 5 wherein said inner part is co-extruded with said surrounding shell portion.

* * * * *